US010351996B2

(12) United States Patent
Pitois et al.

(10) Patent No.: US 10,351,996 B2
(45) Date of Patent: Jul. 16, 2019

(54) PRESSBOARD

(71) Applicant: ABB Schweiz AG, Baden (CH)

(72) Inventors: Claire Pitois, Sundbyberg (SE); Elson Montibon, Oskarshamn (SE); Fredrik Sahlen, Västerås (SE); Lars Schimdt, Bonn (DE); Orlando Girlanda, Västerås (SE); Torbjorn Brattberg, Oskarshamn (SE); Lars Wagberg, Stockholm (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/520,028

(22) PCT Filed: Oct. 16, 2015

(86) PCT No.: PCT/EP2015/074041
§ 371 (c)(1),
(2) Date: Apr. 18, 2017

(87) PCT Pub. No.: WO2016/062638
PCT Pub. Date: Apr. 28, 2016

(65) Prior Publication Data

US 2017/0321378 A1 Nov. 9, 2017

(30) Foreign Application Priority Data

Oct. 20, 2014 (EP) ..... 14189513

(51) Int. Cl.
*H01F 27/32* (2006.01)
*D21H 17/36* (2006.01)
(Continued)

(52) U.S. Cl.
CPC ..... *D21H 17/36* (2013.01); *D21H 17/375* (2013.01); *D21H 17/56* (2013.01); *D21J 1/20* (2013.01); *H01B 3/185* (2013.01); *H01B 3/447* (2013.01); *H01B 3/448* (2013.01); *H01B 3/52* (2013.01); *H01F 27/32* (2013.01); *D21H 17/00* (2013.01); *H01F 27/00* (2013.01)

(58) Field of Classification Search
CPC ..... H01F 27/00–27/36
USPC ..... 336/55–62, 65, 90, 206–208
See application file for complete search history.

(56) References Cited

U.S. PATENT DOCUMENTS 4,946,557 A * 8/1990 Svending ..... D21H 21/10 162/164.6
6,132,558 A 10/2000 Dyllick-Brenzinger et al.
(Continued)

FOREIGN PATENT DOCUMENTS

CN 103476988 A 12/2013
EP 1579071 A1 9/2005
(Continued)

OTHER PUBLICATIONS

European Search Report Application No. 14189513.6 Completed Date: Jun. 1, 2015; dated Jun. 10, 2015 5 Pages.
(Continued)

*Primary Examiner* — Tuyen T Nguyen
(74) *Attorney, Agent, or Firm* — Whitmyer IP Group LLC

(57) ABSTRACT

A cellulose based pressboard for insulation in an electrical power transformer, the pressboard includes polyvinylamine (PVAm), and polyacrylamide (PAM), in a combined amount of between 0.01% and 20% by weight of the pressboard.

12 Claims, 1 Drawing Sheet

(51) Int. Cl.

| | |
|---|---|
| ***D21H 17/37*** | (2006.01) |
| ***D21J 1/20*** | (2006.01) |
| ***H01B 3/18*** | (2006.01) |
| ***H01B 3/44*** | (2006.01) |
| ***H01B 3/52*** | (2006.01) |
| ***D21H 17/56*** | (2006.01) |
| *D21H 17/00* | (2006.01) |
| *H01F 27/00* | (2006.01) |

(56) References Cited

U.S. PATENT DOCUMENTS

| | | | | |
|---|---|---|---|---|
| 6,736,933 | B2 | 5/2004 | Jewell et al. | |
| 6,980,076 | B1 * | 12/2005 | Rolling | H01B 3/52 174/124 R |
| 9,034,146 | B2 * | 5/2015 | Mahoney | D21H 17/675 162/168.4 |
| 9,702,085 | B2 * | 7/2017 | Kosonen | D21H 11/20 |
| 2009/0159228 | A1 * | 6/2009 | Law | C03C 25/328 162/157.4 |
| 2011/0155339 | A1 * | 6/2011 | Brungardt | D21H 21/18 162/164.6 |
| 2012/0080156 | A1 * | 4/2012 | Laleg | D21H 11/18 162/158 |
| 2014/0216671 | A1 * | 8/2014 | Feng | D21H 17/375 162/168.3 |
| 2015/0218756 | A1 * | 8/2015 | Kosonen | D21H 11/18 162/141 |

FOREIGN PATENT DOCUMENTS

| | | | |
|---|---|---|---|
| EP | 1938967 | A1 | 7/2008 |
| EP | 2617896 | A1 | 7/2013 |
| EP | 3012282 | A1 | 4/2016 |
| WO | 2010141757 | A2 | 12/2010 |
| WO | 2011090672 | A1 | 7/2011 |

OTHER PUBLICATIONS

International Preliminary Report on Patentability Application No. PCT/EP2015/074041 dated Sep. 14, 2016 7 Pages.

International Search Report & Written Opinion Application No. PCT/EP2015/074041 Completed Date: Dec. 3, 2015; dated Dec. 14, 2015 11 Pages.

* cited by examiner

PRESSBOARD

TECHNICAL FIELD

The present disclosure relates to a cellulose based pressboard for insulation in an electrical power transformer, as well as to such a transformer and a method for producing a pressboard.

BACKGROUND

In different parts of electrical transformers, insulating material is used to avoid flash-overs and such. This insulating material is typically cellulose based since such a paper or pressboard material is cheap and easy to handle while giving good insulation and has suitable mechanical, electrical and thermal properties. Examples of insulators in an oil filled transformer are:

- spacers, positioned between the turns/discs of a winding, allowing oil to circulate there between.
- axial sticks, positioned between the winding and the core, or between different windings.
- cylinders positioned around a winding, between the winding and its core, or between different windings.
- winding tables, positioned atop and below the plurality of windings, supporting the same.
- insulation coating of the conductor of the windings.

Pressboard is a class of cellulose-based material, typically constructed of one or several layers (plies) of paper which, when compressed using a combination of heat and pressure, form a stiff, dense material in a range of weights.

Pressboard has been used as insulation material in power transformers for many years. The composition and manufacturing process of pressboard have remained basically unchanged for as many years. There are a number of reasons for such lack of innovation. Pressboard mainly offers, at a relatively cheap price, good mechanical and electrical properties. In addition to that, easy machinability and versatility in the workshop increase the value of the material.

However, there are some aspects of the pressboard material that could desirably be improved. These aspects are mainly related to mechanical properties of the material. A challenge is to improve the in-plane and out-of-plane mechanical properties of pressboard, without degrading the dielectric properties thereof. Improved in-plane stiffness and strength would bring about higher bending stiffness of both single sheet and laminate materials. Higher rigidity in the out-of-plane helps both during manufacturing process and during transformer life time.

It is important to bear in mind that in-plane and out-of-plane properties are not directly connected, in the sense that an improvement of the first does not necessarily cause an improvement of the second and vice versa.

U.S. Pat. No. 6,736,933 discloses a multi-ply paperboard comprising at least one ply of conventional cellulose fibers and from about 0.1 to about 6 weight percent of a water-borne binding agent, and at least one ply of chemically intrafiber crosslinked cellulosic high-bulk fibers and from about 0.1 to about 6 weight percent of a water-borne binding agent. The water-borne binding agent may be a starch, a modified starch, a polyvinyl alcohol, a polyvinyl acetate, a polyethylene/acrylic acid copolymer, an acrylic acid polymer, a polyacrylate, a polyacrylamide, a polyamine, guar gum, an oxidized polyethylene, a polyvinyl chloride, a polyvinyl chloride/acrylic acid copolymer, an acrylonitrile/butadiene/styrene copolymer or polyacrylonitrile.

SUMMARY

It is an objective of the present disclosure to provide a pressboard with improved mechanical properties.

According to an aspect of the present invention, there is provided a cellulose based pressboard for insulation in an electrical apparatus. The pressboard comprises polyvinylamine (PVAm), and polyacrylamide (PAM), in a combined amount of between 0.01% and 20% by weight of the pressboard.

According to another aspect of the present invention, there is provided a use of an embodiment of a pressboard of the present invention as insulation material in an electrical apparatus, e.g. a transformer.

According to another aspect of the present invention, there is provided an electrical apparatus comprising a solid insulation material made from an embodiment of the pressboard of the present invention. In some embodiments the electrical apparatus is an electrical transformer (e.g. a power transformer or distribution transformer) comprising a transformer winding, an insulation fluid with which the transformer is filled, and a solid insulation material made from an embodiment of the pressboard of the present invention.

According to another aspect of the present invention, there is provided a method for producing a cellulose based pressboard. The method comprises providing a cellulose pulp, mixing an amount of cationic PVAm into the pulp, mixing an amount of anionic PAM into the pulp, and applying pressure to the PVAm and PAM containing pulp to form the pressboard. The combined amount of PVAm and PAM in the pressboard is between 0.01% and 20% by weight of the pressboard.

By using a combination of PVAm and PAM as additives in the pressboard, an increase of the in-plane tensile strength as well as a reduced out-of-plane compressibility is achieved. For instance, cationic PVAm may bind with negatively charged cellulose, making the surface positive. Addition of anionic PAM will make the surface slightly negative. With this layer-by-layer formation of the polyelectrolytes PVAm and PAM, the cellulose fibre becomes stronger and stiffer, and possibly also repair weaker areas along the fibres. The additives may also strengthen the fibre-fibre bonds, giving an overall better mechanical performance.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Figure 1:
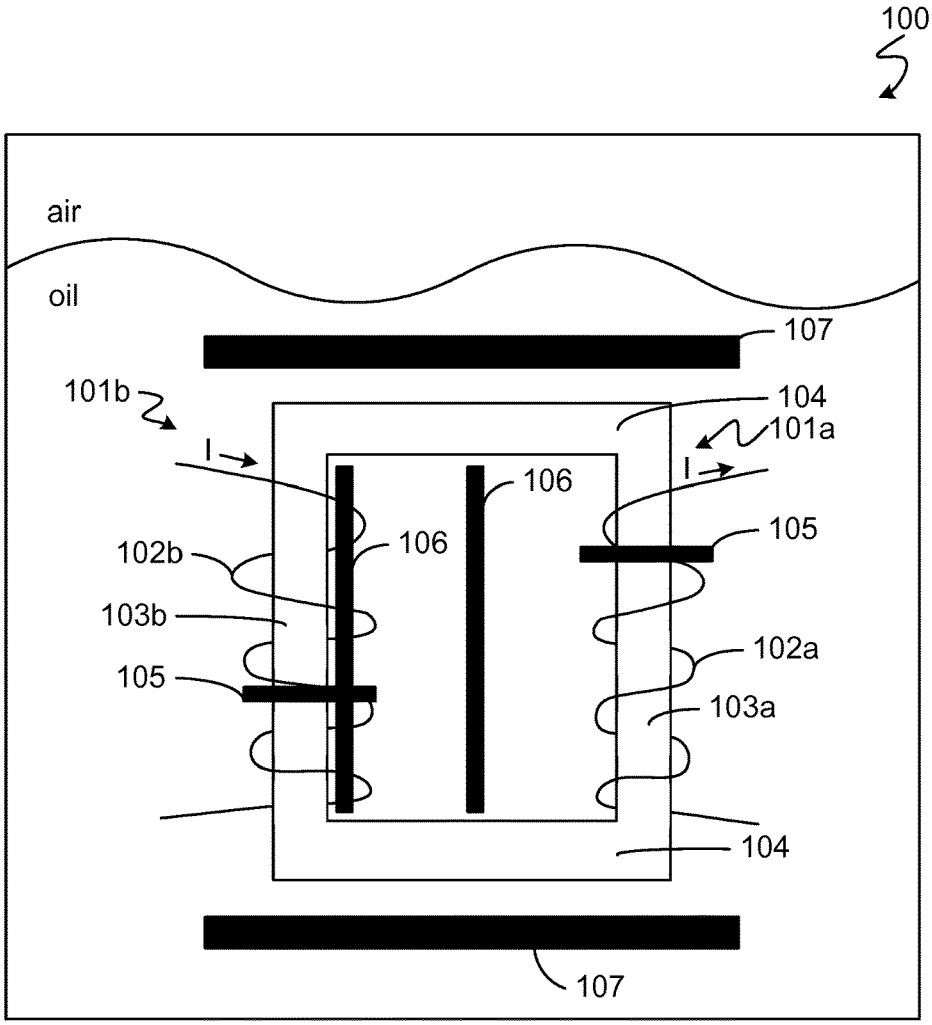
FIG. 1 is a schematic section of an embodiment of a transformer with insulators made from the pressboard of the present invention.

FIG. 1 schematically illustrates an embodiment of an electrical apparatus in the form of an electrical transformer 100. Other examples of electrical apparatuses in which the insulating pressboard may be beneficially used include e.g. electrical motors, generators and switches. The transformer of FIG. 1 is at least partly oil-filled (schematically illustrated by the wavy oil-air interface indicated in the figure), e.g. with a mineral oil or with an ester-based oil. It is noted that the figure is only schematic and provided to illustrate in particular some of the different kinds of insulators which may be made by the pressboard of the present invention.

Two neighbouring windings 101 (a & b) are shown, each comprising a coil of an electrical conductor 102 (a & b) around a core 103 (a & b), e.g. a metal core. The cores 103*a* and 103*b* are connected and fixed to each other by means of top and bottom yokes 104. This is thus one example set up of a transformer, but any other transformer set up can alternatively be used with the present invention, as is appreciated by a person skilled in the art.

The conductors 102 are insulated from each other and from other parts of the transformer 100 by means of the fluid which the transformer contains (i.e. the oil in the embodiment of FIG. 1). However, also solid insulators are needed to structurally keep the conductors and other parts of the transformer immobile in their intended positions. Today, such solid phase insulators are typically made of cellulose based pressboard or Nomex™ impregnated by the insulating fluid. In contrast, according to the present invention, a pressboard comprising additives in the form of PVAm and PAM is used for making at least some of the solid insulators. The insulators may e.g. be in the form of spacers 105 separating turns or discs of a winding 101 from each other, axial sticks 106 e.g. separating the conductor 102 winding 101 from its core 103 or from another winding 101, winding tables 107 separating the windings from other parts of the transformer 100 e.g. forming a support or table on which the windings, cores, yokes etc. rest, as well as insulating coating (not shown) of the conductor 102 forming the winding 101. In the figure, only a few different example insulators are shown for clarity. For instance, a cylinder around a winding, between a winding and its core or between different windings (e.g. between high voltage and low voltage windings), made from the insulating composite material may be used in some embodiments. Such a cylinder may provide mechanical stability to windings when the conductor is e.g. wound over/onto the cylinder, and it may break the large oil gaps between two windings (e.g. low voltage and high voltage winding), which improves the overall insulation strength of the gap between the two windings. In some embodiments, concentric cylinders around the core may be used to separate and insulate different conductor layers of a winding from each other.

The spacers 105 are positioned between turns or discs of the conductor 103, separating the turns or discs from each other. It is advantageous to use a substantially rigid and non-porous material for spacers 105 in order to avoid that the spacers are compressed during manufacturing or use. It is a problem of cellulose pressboard that they are compressed over time, leading to change in height of winding which result in axial imbalance between the windings 101. The axial imbalance between two windings results in higher axial short circuit forces. Further, the spacers need to withstand the stress put on them. The axial sticks 106 are positioned along the winding 101, e.g. between the conductor 102 of the winding and its core 103 or between two windings 101, insulating and spacing them from each other. Also winding sticks should be able to withstand stress in order to not break or be deformed. The winding table 107 should be able to support the relatively heavy winding/core assembly. As discussed herein, by using the pressboard with additives in accordance with the present invention, the compressibility as well as the tensile strength is improved compared with commonly used pressboard.

Figure 2:
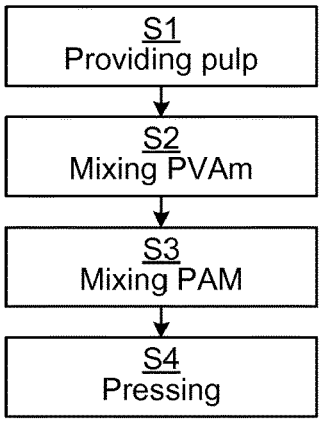
FIG. 2 is a schematic flow chart of an embodiment of the method of the present invention.

FIG. 2 is a schematic flow chart of an embodiment of the method of the present invention. The method is for producing a cellulose based pressboard having improved properties as discussed herein. A cellulose pulp, e.g. a sulphite pulp, is provided S1. An amount of PVAm, which is typically cationic, is mixed S2 into the pulp. Similarly, an amount of PAM, which is typically anionic, is mixed S3 into the pulp. The PVAm and the PAM may be mixed into the pulp at the same time or one after the other. For instance, cationic PVAm may first be mixed S2 into the pulp, possibly followed by some additional stirring, before anionic PAM is mixed S3 into the pulp, or the PAM may be mixed S3 into the pulp before the PVAm is mixed S2 into it. Alternatively, the PVAm and PAM may first be mixed with each other before the combined additives are mixed S2 and S3 into the pulp. An advantage with first mixing a cationic additive, e.g. cationic PVAm, with the pulp is that the cellulose fibres of the pulp are typically anionic, allowing a cationic additive to bind to the cellulose of the pulp, after which an anionic additive, e.g. anionic PAM, is mixed with the pulp allowing the anionic additive to bind to the cationic additive already bound to the cellulose. The additives PVAm and PAM may e.g. be in the form of an aqueous solution, suspension or slurry, or a powder, when mixed S2 and S3 into the pulp. Then, the paper pulp is made into a pressboard from one or several plies in a conventional manner, including applying S4 pressure, and typically also heat, to the PVAm and PAM containing pulp/paper plies to form the pressboard. The produced pressboard has an additive amount (PVAm+PAM) of between 0.01% and 20% by weight of the pressboard.

Experiments were made (see e.g. the examples below) to determine the more suitable amounts of the additives. The amounts should be large enough to achieve the improved properties but without using more additive than necessary. It was found that a combined amount of PVAm and PAM of between 0.01% and 20% by weight (wt %) of the pressboard is suitable, preferably between 0.01 and 5 wt %, e.g. between 0.02 and 2 wt %, such as between 0.02 and 1 wt % or between 0.03 and 0.5 wt %. It was also found that the ratio between the PVAm and PAM additives could influence the properties of the pressboard, allowing the additives to cooperate suitably with each other. A weight ratio of PVAm to PAM which is between 1:1 and 2:1, e.g. about 3:2, is suitable. Typically, the amount of PVAm in the pressboard is between 0.01 and 5 wt %, e.g. between 0.01 and 1 wt %, such as between 0.02 and 0.3 wt %. Similarly, typically, the amount of PAM in the pressboard is between 0.01 and 5 wt %, e.g. between 0.01 and 1 wt %, such as between 0.01 and 0.2 wt %. It is noted that the amounts discussed herein are the amounts in the produced board, not the amounts added to the pulp before producing the board thereof. At least some of the additive mixed with the pulp may leave during production, typically with the moisture of the pulp during pressing. For example, the retention of the additives may be between 20 and 90 wt % of the amount mixed with the pulp.

In some embodiments of the present invention, the pressboard is a high density pressboard having an apparent density of at least 1 g/cm$^3$, as measured in accordance with IEC 641-2 in standard atmosphere and 23° C., but in other embodiments of the present invention the pressboard is a low density pressboard. A high density pressboard may be suitable to achieve a suitable strength and rigidness of the pressboard, especially if it is load bearing, and the high density then combines with the additives to achieve improved mechanical properties, especially reduced out-of-plane compressibility (i.e. compression of the pressboard thickness) and improved in-plane tensile strength (to handle tensile stresses along, not between, the paper sheets of the pressboard.

In some embodiments of the present invention, the pressboard is in the form of a spacer 105, an axial stick 106 or a winding table 107, or any other type of solid insulator in a transformer, e.g. a spacer for a winding 101 in an electrical power transformer 100. For instance, the pressboard solid insulation material may be in the form of a plurality of spacers 105 integrated with the winding 101.

The transformer may be a power transformer, typically filled with an electrically insulating liquid such as a mineral oil or an ester-based liquid or oil. In some embodiments, the transformer is configured for high voltage applications.

EXAMPLES

The following pressboard samples with different combined amounts of PVAm and PAM in ratio 3:2 by weight were used and compared with a reference board without PVAm and PAM. It is noted that amounts of additive below for the different samples are the amounts added to the pulp. Depending on the retention, the amount in the produced board may be lower. In some other experiments, the retention was estimated to be about 50%, but may vary between 20 and 90%.

1. Reference
2. PVAm and PAM 0.15 wt %
3. PVAm and PAM 0.3 wt %
4. PVAm and PAM 0.75 wt %
5. PVAm and PAM 1.5 wt %

The weight percentage is calculated based on the weight of the additive, not the additive suspension/slurry/solution, and on the dry weight of the pulp, excluding the moisture in the pulp. The base pulp was sulphite pulp without additives to ensure good dielectric properties. The PVAm and PAM were delivered separately in water solutions. Cationic PVAm was purchased from BASF, trade name Luredur VM, and had a concentration of circa 15 wt %. The solution of anionic polyacrylamide (PAM) was also purchased from BASF, trade name Luredur AM, and had a concentration of circa 15 wt %.

PVAm and PAM were charged to the stock in the ratio of 3:2. First the cationic PVAm was charged and the stock was stirred for ten minutes. Then the anionic PAM was charged.

Tensile tests were performed according to IEC standard 60641-2. The experiments were performed at room temperature and at 110° C. in both machine direction (MD) of the paper machine and cross-machine direction (CD) of the paper machine. The data included the values of strength and stiffness.

Compressibility tests were performed according the IEC standard 60641-2. The values of compressibility and reversible compressibility are specified by the IEC standard 60641. These properties are relevant for pressboard used in spacers, typically non-laminated high density (HD) pressboard with a thickness ranging from 1 mm to 3 mm. The practical reason for such a requirement is the necessity of defining the winding height at different stages of the transformer production. Stiffer material in the thickness direction causes smaller deformations and hence reduces the need of including adjustment spacers.

The tests were performed on both dry material at room temperature and on hot and dry material at 110° C. The choice of running the compressibility tests at high temperature was aimed at understanding how much the increased temperature would reduce the out-of-plane mechanical properties of the modified materials. It is known that some additives have lower mechanical properties at high temperatures. The equipment used for the compressibility tests, i.e. plates and connections to the piston, were inserted in an oven. The temperature was monitored by two sensors. One sensor measured the air temperature. The second sensor was inserted in a stack of pressboard that had the same height of the tested samples. The dummy stack was used as a reference for temperature in the middle of the tested stack. The test pieces tested at 110° C. were kept in a hot air oven before testing. After being transferred form the hot air oven to the tensile testing machine, the compressibility tests started when the temperature in the dummy reached an the 110° C. mark.

Tensile Test

The summary of the results for the tensile strength and elastic modulus values of the reference and modified pressboard can be found in Table 1 (below).

Most of the test pieces showed an improvement in the tensile strength at room temperature (RT). The improvement also holds for the test performed at 110° C.

TABLE 1

Values of the tensile strength and elastic modulus at RT and 110° C.

| | Property | | | | | | | |
|---|---|---|---|---|---|---|---|---|
| | Tensile test (RT) | | E-modulus (RT) | | Tensile test (110° C.) | | E-modulus (110° C.) | |
| | Direction | | | | | | | |
| | MD | CD | MD | CD | MD | CD | MD | CD |
| | Unit | | | | | | | |
| Sample | kN/m | kN/m | MPa | MPa | kN/m | kN/m | MPa | MPa |
| Reference | 90.47 | 78.28 | 534.12 | 535.11 | 73.93 | 72.49 | 533.08 | 528.5 |
| 0.15% | 106.4 | 91.07 | 684.17 | 583.47 | 93.93 | 74.39 | 646.81 | 511 |
| 0.3% | 137.2 | 86.91 | 905.04 | 568.65 | 114.77 | 70.3 | 742.01 | 481.85 |
| 0.75% | 148.76 | 96.75 | 867.69 | 610 | 119.62 | 77.63 | 731.11 | 519.75 |
| 1.5% | 153.33 | 102.54 | 863.18 | 615.28 | 122.01 | 80.87 | 744.55 | 507.69 |

Compressibility Test

The overall summary of the results of the compressibility tests performed according to the IEC standard is presented in Table 2 (below). A low compressibility and a high reversible compressibility is sought. The values of the combination PVAm+PAM at 10% are not available due to shortage of material.

TABLE 2

Summary of the compressibility and reversible compressibility values for the tested sample materials

| | RT | | 110° C. | |
|---|---|---|---|---|
| Sample | Compr. | Rev. Compr. | Compr. | Rev. Compr. |
| Reference | 10.8 | 57 | 12.1 | 38.8 |
| 0.15% | 10.2 | 58.3 | 12 | 41.1 |
| 0.3% | 8.9 | 55.9 | 11.3 | 43.7 |
| 0.75% | 9 | 54.1 | 11.1 | 46.4 |

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. An electrical apparatus comprising a solid insulation material made from a pressboard comprising:

cationic polyvinylamine (PVAm); and anionic polyacrylamide (PAM);

in a combined amount of between 0.01% and 20% by weight of the pressboard;

wherein the weight ratio of PVAm and PAM is between 1:1 and 2:1.

2. The electrical apparatus comprising a solid insulation material made from a pressboard of claim 1, wherein the combined amount of PVAm and PAM in the pressboard is between 0.01 and 5 wt %.

3. The electrical apparatus comprising a solid insulation material made from a pressboard of claim 1, wherein the amount of PVAm in the pressboard is between 0.01 and 5 wt %.

4. The electrical apparatus comprising a solid insulation material made from a pressboard of claim 1, wherein the amount of PAM in the pressboard is between 0.01 and 5 wt %.

5. The electrical apparatus comprising a solid insulation material made from a pressboard of claim 1, wherein a cellulose of the pressboard is from sulphite pulp.

6. The electrical apparatus comprising a solid insulation material made from a pressboard of claim 1, wherein the pressboard is in the form of a spacer, an axial stick or a winding table.

7. The electrical apparatus of claim 1, wherein the apparatus is a transformer comprising:

a transformer winding; and an insulation fluid with which the transformer is filled.

8. The transformer of claim 7, wherein the solid insulation material is in the form of a plurality of spacers integrated with the winding.

9. The transformer of claim 7, wherein the insulation fluid is a liquid.

10. The transformer of claim 7, wherein the transformer is a power transformer configured for high voltage operation.

11. The pressboard of claim 1, wherein a weight ratio of PVAm to PAM is 3:2.

12. The pressboard of claim 1, wherein the solid insulation material further comprises a sulphite pulp.

* * * * *